US005671850A

United States Patent [19]

Basala

[11] Patent Number: 5,671,850

[45] Date of Patent: Sep. 30, 1997

[54] STORAGE RACK APPARATUS

[76] Inventor: Donald C. Basala, 421 E. Jessup Rd., Plainfield, Ind. 46168

[21] Appl. No.: 419,369

[22] Filed: Apr. 10, 1995

[51] Int. Cl.[6] ..... A47F 5/00

[52] U.S. Cl. ..... 211/23; 211/99; 211/104; 224/42.25

[58] Field of Search ..... 211/20, 21, 23, 211/89, 90, 99, 100, 101, 104; 248/240, 240.3, 240.4; 224/42.15, 42.21, 42.25; 414/463, 464, 466

[56] References Cited

U.S. PATENT DOCUMENTS

| | | | |
|---|---|---|---|
| 1,146,417 | 7/1915 | Flynn . | |
| 1,368,687 | 2/1921 | Bennetts . | |
| 1,895,024 | 1/1933 | Coquille | 224/42.15 |
| 2,100,261 | 11/1937 | Montgomery | 211/104 X |
| 3,151,576 | 10/1964 | Patterson . | |
| 3,161,160 | 12/1964 | Wilson . | |
| 3,174,628 | 3/1965 | Kirch, Jr. | 248/224.7 X |
| 3,352,594 | 11/1967 | Miller . | |
| 3,667,714 | 6/1972 | Ziaylek . | |
| 3,797,670 | 3/1974 | Lovemour | 211/99 X |
| 3,812,974 | 5/1974 | Sylvester . | |
| 4,126,231 | 11/1978 | Derwent-Wryde | 211/99 |
| 4,228,936 | 10/1980 | Rife | 414/463 X |
| 4,573,855 | 3/1986 | Braswell | 224/42.25 X |
| 4,988,066 | 1/1991 | Cotterill . | |
| 5,007,567 | 4/1991 | Foster | 224/42.25 X |
| 5,058,846 | 10/1991 | Close | 211/104 X |
| 5,117,986 | 6/1992 | Lin . | |
| 5,333,766 | 8/1994 | Fisher | 224/42.25 X |
| 5,449,031 | 9/1995 | Burklund | 414/463 X |

FOREIGN PATENT DOCUMENTS

| | | |
|---|---|---|
| 1354317 | 6/1964 | France . |
| WO 94/09688 | 5/1994 | WIPO . |

*Primary Examiner*—Robert W. Gibson, Jr.
*Attorney, Agent, or Firm*—Barnes & Thornburg

[57] ABSTRACT

A storage rack apparatus is configured to be mounted on a wall for holding articles. The storage rack apparatus includes a back frame section configured to be rigidly coupled to the wall, and a bottom frame section pivotably coupled to the back frame section. The bottom frame section includes a first support member and a second support member spaced apart from the first support member for holding the articles therebetween when the bottom section is in an upwardly pivoted storage position. The apparatus also includes a loading bar coupled to the bottom frame section. The loading bar includes a frame member extending generally parallel to the first and second support members of the bottom section for holding the articles in a downwardly pivoted loading and unloading position. The apparatus further includes at least one spring assist assembly coupled between the back frame section and the bottom frame section to assist pivotable movement of the bottom frame section and the loading bar relative to the back frame section.

18 Claims, 3 Drawing Sheets

STORAGE RACK APPARATUS

BACKGROUND AND SUMMARY OF THE INVENTION

The present invention relates to an improved storage rack apparatus. More particularly, the present invention relates to a space saving storage system for storing tires and other equipment in a position which is close to a ceiling or roof to maximize utilization of storage space within a garage or trailer.

Storage of tires, particularly for racing teams, takes up a substantial amount of space in a trailer or garage area. Typically, a racing team will take several tires mounted on rims to each racing event. Storing and transporting such a large number of tires becomes problematical.

The improved storage rack apparatus of the present invention provides an apparatus which saves floor space in a trailer or garage area by providing an apparatus which stores the tires and other equipment up near a ceiling or roof structure. Therefore, the tires are stored out of the way of other items. By storing the tires up and out of the way in the trailer or garage, more floor space can be used to store additional items or for work areas. The improved storage rack apparatus of the present invention can be mounted on a wall of the garage or trailer. In addition, the apparatus can be mounted on a movable rack to provide a free-standing support and storage unit.

The storage rack apparatus also includes a foldable work bench or shelf which cooperates with the storage rack apparatus. The work bench or shelf is pivotably mounted to the wall or support unit below the storage rack apparatus. The work bench or shelf can pivot upwardly to a position which is parallel to the wall.

The storage rack apparatus of the present invention is preferably made from a steel construction and is available in four foot, five foot, and six foot lengths. Other lengths can be provided if desired. The steel can be unfinished, painted, or nickel plated.

Advantageously, the improved storage rack apparatus of the present invention provides a support structure for holding a plurality of tires and other equipment in an upwardly pivoted, stowed or storage position. The storage rack apparatus prevents the tires from falling out during transport. The apparatus includes a spring assisted pivot assembly to help an operator with raising and lowering the tires to and from a downwardly pivoted loading and unloading position. Advantageously, the storage rack apparatus also holds the tires on the rack in the downwardly pivoted, loading and unloading position for easy loading or removal. The spring assist moves past a pivot point of the apparatus to hold the storage rack apparatus in the downwardly pivoted position. Therefore, when the last tire is removed, the storage rack will not spring upwardly until it is manually pulled up by an operator.

According to one aspect of the present invention, a storage rack apparatus is configured to be mounted on a wall for holding articles. The storage rack apparatus includes a back frame section configured to be rigidly coupled to the wall, and a bottom frame section pivotably coupled to the back frame section. The bottom frame section includes a first support member and a second support member spaced apart from the first support member for holding the articles therebetween when the bottom section is in an upwardly pivoted storage position. The apparatus also includes a loading bar coupled to the bottom frame section. The loading bar includes a frame member extending generally parallel to the first and second support members of the bottom section for holding the articles in a downwardly pivoted loading and unloading position. The apparatus further includes at least one spring assist assembly coupled between the back frame section and the bottom frame section to assist pivotable movement of the bottom frame section and the loading bar relative to the back frame section.

In the illustrated embodiment, the bottom frame section includes a first side frame member and a second side frame member. The first and second side frame members are pivotably coupled to the back frame section. The first and second support members extend between the first and second side frame members.

Also in the illustrated embodiment, the position of the second support member is adjustable on the first and second side frame members relative to the first support member of the bottom frame section. A distance from the frame member of the loading bar to the first support member of the bottom frame section is also adjustable to accommodate different size articles.

The apparatus further includes a locking assembly coupled to the back frame section. The locking assembly includes a locking pin configured to engage an aperture formed in the bottom frame section to hold the bottom frame section in the upwardly pivoted storage position.

According to another aspect of the present invention, a storage rack apparatus configured to be coupled to a wall is provided for storing a plurality of tires. The apparatus includes a back frame section configured to be rigidly coupled to the wall, and a bottom frame section pivotably coupled to the back frame section. The bottom frame section is pivotable relative to the back frame section from an upwardly pivoted storage position to a downwardly pivoted loading and unloading position. The bottom frame section is configured to hold the tires on the storage rack when the bottom section is in the upwardly pivoted storage position. The apparatus also includes a loading bar coupled to the bottom frame section. The loading bar is configured to hold the tires on the storage rack when the bottom section is in the downwardly pivoted loading and unloading position.

In the illustrated embodiment, the bottom frame section includes a first support member and a second support member spaced apart from the first support member for holding the tires in a nested position therebetween when the bottom section is in the upwardly pivoted storage position. The loading bar includes a frame member extending generally parallel to the first support member of the bottom section for holding the tires in a nested position therebetween when the bottom frame section is in the downwardly pivoted loading and unloading position.

The apparatus further includes at least one spring assist assembly coupled between the back frame section and the bottom frame section to assist pivotable movement of the bottom frame section and the loading bar relative to the back frame section. In the illustrated embodiment, the back frame section includes an extender section and the bottom frame section is pivotably coupled to the extender section about a pivot axis so that the at least one spring assist assembly moves past the pivot axis when the bottom frame section and the loading bar are in the downwardly pivoted loading and unloading position to hold the bottom frame section and loading bar in the downwardly pivoted loading and unloading position.

According to yet another aspect of the present invention, a support frame apparatus is configured to be mounted on a wall below the back frame section of the storage rack. The support frame apparatus includes a fixed frame member rigidly coupled to the wall. The fixed frame member includes first and second side walls, a pivot pin extending between the first and second side walls, and a front wall having a top surface located below the pivot pin. The support frame apparatus also includes a pivotable frame member having first and second side walls and a bottom surface extending between the first and second side walls. The first and second side walls of the pivotable frame member are each formed to include an elongated slot for receiving the pivot pin therethrough. The elongated slots are configured so that the pivotable frame member is movable from an upwardly pivoted storage position in which the pivotable frame member slides into the fixed frame member to an outwardly pivoted position generally perpendicular to the fixed frame member in which the bottom surface of the pivotable frame member abuts the top surface of the front wall of the fixed frame member.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF DRAWINGS

Figure 1:
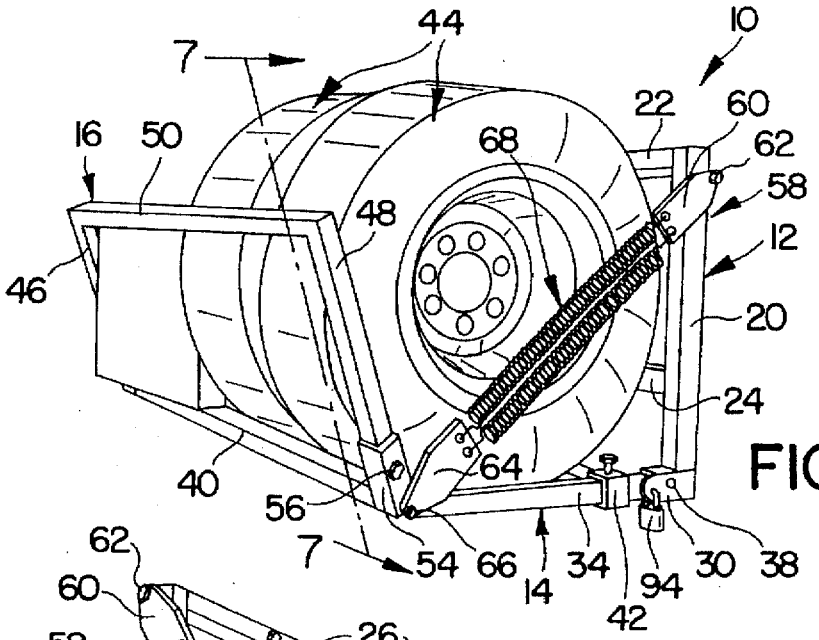
FIG. 1 is a perspective view illustrating the improved storage rack apparatus of the present invention in an upwardly pivoted, storage position to hold a plurality of tires or other equipment up and out of the way in a trailer or garage.
Figure 2:
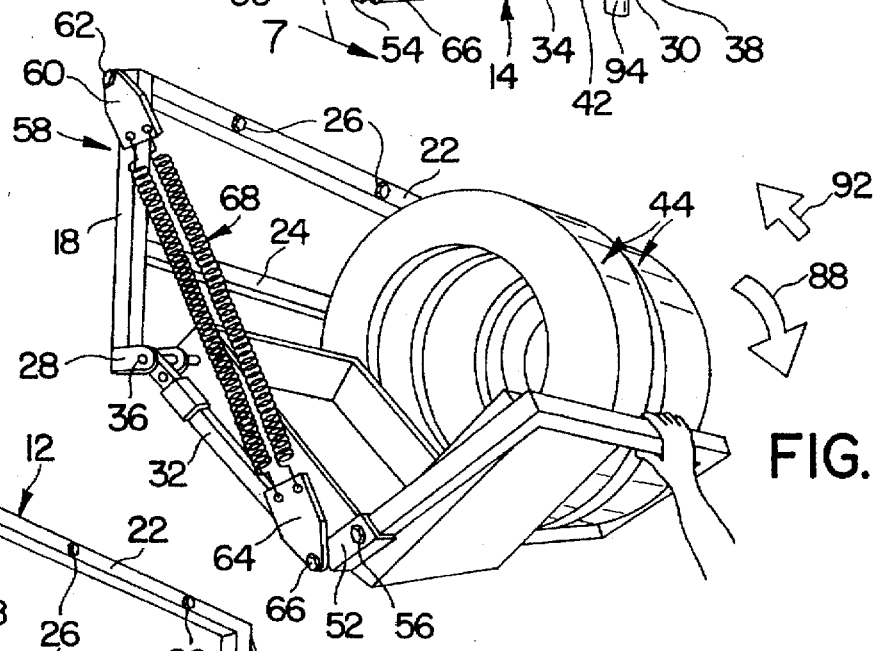
FIG. 2 is a perspective view illustrating pivotal movement of a portion of the storage rack apparatus downwardly toward in an unloading and loading position.
Figure 3:
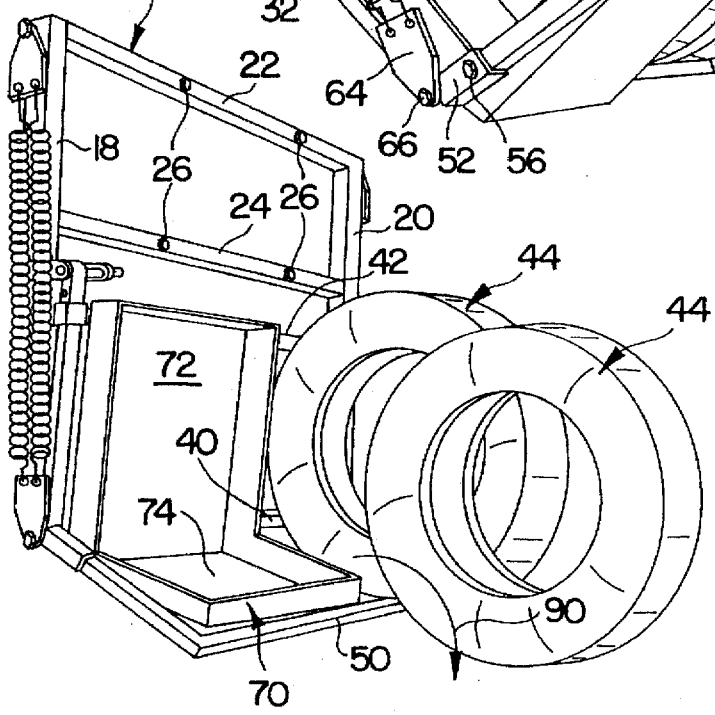
FIG. 3 illustrates the storage rack apparatus of the present invention in its fully downwardly pivoted, loading and unloading position in which a spring assist apparatus has moved past a center pivot point to hold the storage rack apparatus in its downwardly pivoted, loading and unloading position.

Referring now to the drawings, the improved storage rack apparatus of the present invention is best illustrated in FIGS. 1–3. The storage rack apparatus 10 includes a back frame section 12, a bottom frame section 14 pivotably coupled to back frame section 12, and a loading bar 16 coupled to bottom frame section 14. Back frame section 12 is rigidly coupled to a wall of a garage, trailer, or to a free-standing support wall. As best illustrated in FIGS. 2 and 3, back frame section 12 includes two generally vertical side frame members 18 and 20 connected by horizontal frame members 22 and 24. Horizontal frame members 22 and 24 are rigidly coupled to the wall by suitable fasteners 26. Extension sections 28 and 30 are coupled to vertical frame members 18 and 20, respectively.

Bottom frame section 14 includes side frame members 32 and 34 which are pivotably coupled to extension sections 28 and 30 about pivot pins 36 and 38, respectively. Bottom frame section 14 includes a front frame member 40 extending between side frame members 32 and 34. Bottom frame section 14 also includes an adjustable slide bar 42 which extends between frame members 32 and 34. Slide bar 42 is parallel to front frame member 40. In the preferred embodiment, the position of slide bar 42 can be adjusted relative to side frame members 32 and 34 in either direction illustrated by the double headed arrow 43 of FIG. 7 depending upon the size of tires 44 stored in the storage rack apparatus 10.

Loading bar 16 includes side frame members 46 and 48 and a horizontal frame member 50 extending between side frame members 46 and 48. Side frame members 46 and 48 extend into sleeves 52 and 54, respectively. Therefore, loading bar 16 is adjustably coupled to bottom frame section 16. Loading bar 16 is held in position by suitable fasteners 56. Loading bar 16 retains the tires 44 in the storage rack 10 in the upwardly pivoted position of FIG. 1. Loading bar 16 also holds the tires 44 in the storage rack apparatus 10 when the apparatus 10 is in the downwardly pivoted loading and unloading position of FIG. 3. Illustratively, loading bar 16 is aligned at an angle of about 68° relative to side frame numbers 32 and 34 as illustrated by angle 57 in FIG. 7.

Figure 7:
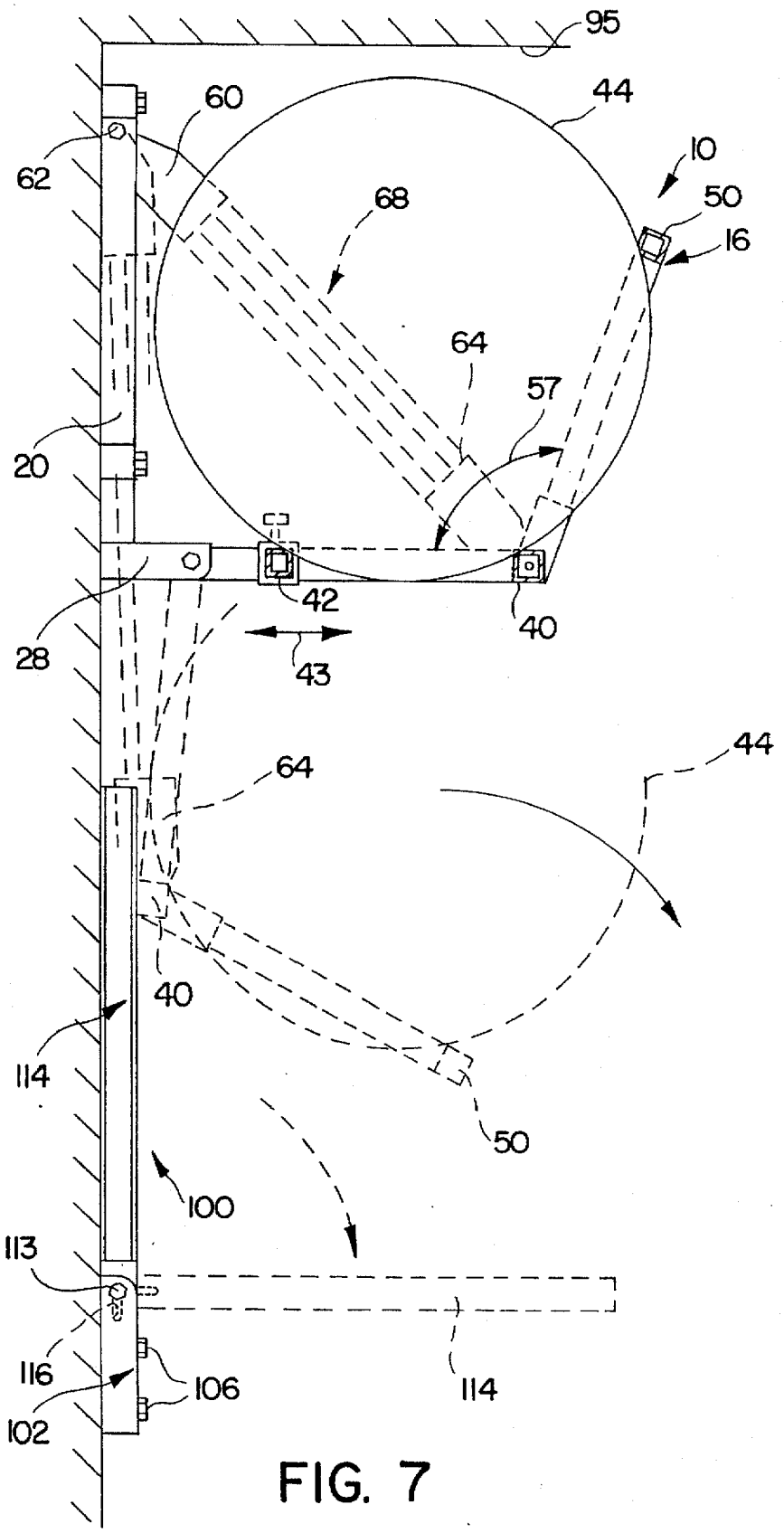
FIG. 7 is a sectional view taken along lines 7—7 of FIG. 1 illustrating operation of the improved storage rack apparatus and work bench or shelf assembly during pivotable movement of the storage rack apparatus from its upwardly pivoted storage position of FIG. 1 to its downwardly pivoted, loading and unloading position of FIG. 3 and illustrating pivotable movement of the work bench or shelf from its upwardly pivoted storage position of FIG. 5 to its outwardly pivoted functional position of FIG. 6.

The storage rack apparatus 10 of the present invention advantageously provides a mechanism for storing tires in a nested position in both the upwardly pivoted storage position of FIG. 1 and the downwardly pivoted loading and unloading position of FIG. 3. In FIG. 1, tires 44 nest between front frame member 40 and slide bar 42. As best illustrated in FIG. 7, the position of slide bar 42 can be adjusted depending on the diameter of the tires 44 so that the tires are held in a nested position without falling through the gap between front frame member 40 and slide bar 42. When the storage rack apparatus is in its downwardly pivoted loading and unloading position of FIG.. 3, the tires nest between the front frame member 40 of bottom frame section 14 and the frame member 50 of loading bar 16. Again, the distance between frame member 40 and frame member 50 can be adjusted by sliding the loading bar 16 within sleeves 52 and 54. This configuration of storage apparatus 10 advantageously facilitates storage as well as loading and unloading of the tires 44.

Movement of the pivotable bottom section 14 of apparatus 10 is assisted by spring assist assemblies 58 which are pivotably coupled to each end of the storage rack apparatus 10. Each spring assist assembly 58 includes a first support plate 60 pivotably coupled by a suitable fastener 62 to back frame section 12. Each spring assist assembly 58 also includes a second support plate 64 pivotably coupled to bottom frame section 14 by suitable fastener 66. A pair of springs 68 are coupled between support plates 60 and 64. Illustratively, springs 68 are each one half of a 100 lb. garage door spring.

An optional storage compartment 70 is also provided. Storage compartment 70 includes a first section 72 extending between slide bar 42 and front frame member 40 of bottom frame section 14. Storage compartment 70 also includes a second section 74 extending between front frame member 40 and horizontal frame member 50 of loading bar 16. Preferably, storage compartment 70 is secured to frame member 50 of loading bar 16 by pop rivets.

Figure 4:
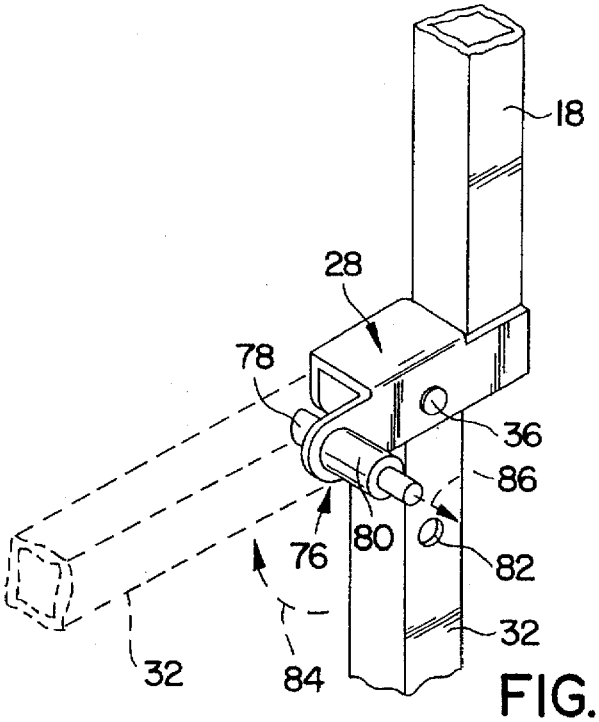
FIG. 4 is a perspective view illustrating details of a pivot assembly and a locking mechanism for the storage rack apparatus of FIGS. 1–3.

Bottom frame section 14 is held in an upwardly pivoted position by a locking mechanism 76 best illustrated in FIG. 4. Locking mechanism 76 is coupled to extension section 28 of back frame section 12. Locking mechanism 76 includes an angled locking pin 78 which is spring biased to the position illustrated in FIG. 4 by a spring (not shown) located in housing 80. Side frame member 32 of bottom frame section 16 is formed to include an aperture 82 aligned with pin 78. Therefore, as the bottom frame section 16 is pivoted upwardly in the direction of arrow 84 side frame member 32 moves to the dotted position of FIG. 4 and engages a ramp surface on pin 78. This causes pin 78 to move inwardly in the direction of arrow 86 so that locking pin 80 enters aperture 82 in side frame section 32 to hold bottom frame section 16 in its upwardly pivoted storage position illustrated in FIG. 1.

In operation, when it is desired to unload tires 44 or items stored within storage compartment 70 from the storage rack apparatus 10 located in its storage position of FIG. 1, an operator first unlatches pin 78 from aperture 80 by moving pin 78 in the direction of arrow 86. Bottom frame section 14 and loading bar 16 are then free to move pivotably downwardly relative to back frame section 12 in the direction of arrow 88 in FIG. 2. As illustrated in FIG. 2, spring assist assemblies 68 facilitate pivotable movement of the storage rack apparatus. Springs 68 expand as bottom frame section 14 and loading bar 16 are pivoted downwardly in the direction of arrow 88.

The operator continues to pivot bottom frame section 14 and loading bar 16 downwardly to the downwardly pivoted, loading and unloading position illustrated in FIG. 3. Tires 44 are held in the loading and unloading position between frame member 40 of bottom frame section 14 and frame member 50 of loading bar 16. Therefore, one tire 44 can be unloaded in the direction of arrow 90 while other tires 44 and items in storage compartment 70 remain in place on storage rack 10.

Advantageously, the spring assist assemblies 58 move beyond the pivot point defined by pivot connections 36 and 38. Therefore, spring assist assemblies 58 hold the bottom frame section 14 and loading bar 16 in the downwardly pivoted position of FIG. 3. Tires 44 and other items can be loaded and held in the downwardly pivoted position of FIG. 3. The operator then pivots bottom frame section 14 and loading bar 16 upwardly in the direction of arrow 92 of FIG. 2. Again, spring assist assemblies 58 assist pivotable movement. Once the bottom frame section reaches its upwardly pivoted storage position of FIG. 1, locking pin 78 automatically locks into aperture 82 of frame member 32 to hold the bottom frame section 14 in the upwardly pivoted storage position. A padlock 94 can be coupled to extension section 30 and side frame member 34 to prevent unloading of the storage rack apparatus 10 by unauthorized personnel.

Typically, storage rack apparatus 10 is positioned as close to a ceiling 95 of the workshop, garage or trailer as possible as illustrated in FIG. 7 so that the tires 44 cannot be removed unless the bottom section 14 and loading bar 16 are pivoted downwardly to the loading and unloading position illustrated in FIG. 3. This provides security for the tires 44 when padlock 94 is used. This configuration also stores the tires 44 up and out of the way to maximize use of storage space. This feature is discussed below with reference to FIG. 7.

Figure 5:
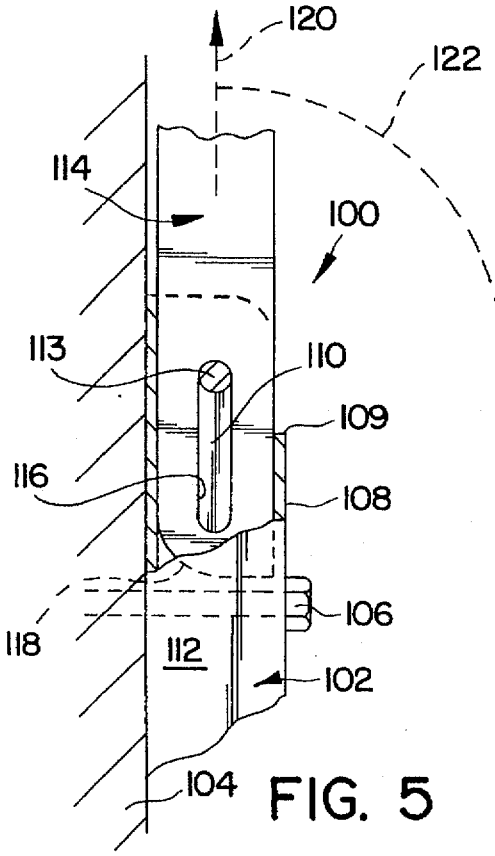
FIG. 5 is a partial side elevational view, with portions broken away, illustrating a pivotably frame assembly mounted to a wall for supporting a work bench or shelf beneath the storage rack apparatus of FIGS. 1–3.
Figure 6:
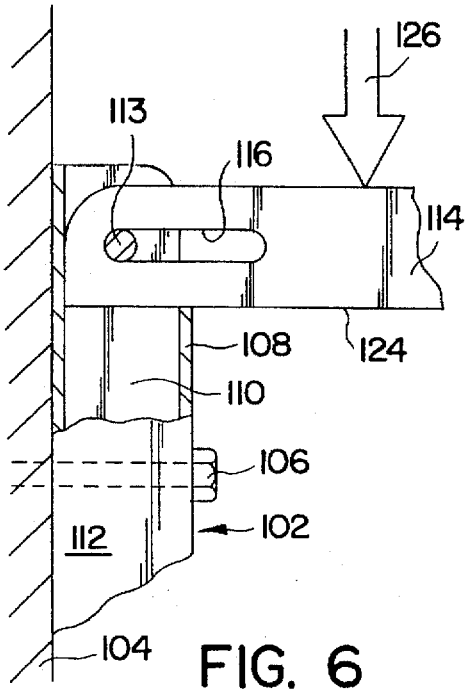
FIG. 6 is a side elevational view similar to FIG. 5, with portions broken away, illustrating the frame assembly in an outwardly pivoted position.

Another aspect of the present invention includes the provision of a work bench or shelf located below the storage rack apparatus 10. The frame assembly 100 for supporting the shelf is best illustrated in FIGS. 5 and 6. The support frame assembly 100 includes a fixed frame member 102 rigidly coupled to a wall 104 by suitable fasteners 106. Frame member 102 includes a front wall section 108, opposite side walls 110 and 112, and a pivot pin 113 extending between side walls 110 and 112. A top surface 109 of front wall 108 is located below pivot pin 113. Support frame assembly 100 also includes a pivotable frame member 114 having an elongated slot 116 formed in opposite side walls. Frame member 114 includes a curved in portion 118 to facilitate pivotable movement of frame member 114 relative to frame member 102. Frame member 114 is sized to slide within frame member 102.

In order to pivot frame member 114 relative to frame member 102, frame member 114 is first lifted upwardly in the direction of arrow 120 and then pivoted downwardly in the direction of arrow 122. In the downwardly pivoted position, top surface 109 of the front wall 108 of fixed frame member 102 engages a bottom surface 124 of frame member 114 to hold frame member 114 in a position generally perpendicular to frame member 102 as illustrated in FIG. 6. Preferably, at least two such frame assemblies are spaced apart on wall 104. A suitable shelf, bench, bed, or other support structure can then be coupled to frame members 114. Therefore, the shelf, bench, or bed supports a downward force in the direction of arrow 126. When frame member is pivoted back to the position of FIG. 5, frame member 114 slides downwardly into fixed frame member 102 to hold frame member 114 in an upwardly pivoted storage position.

FIG. 7 illustrates the operation of the total system including the storage rack apparatus 10 and the pivotable shelf or work bench frame assembly 100. As illustrated in FIG. 7, when frame member 114 is pivoted upwardly against wall 104, frame member 114 nests behind bottom frame section 14 when bottom frame section 14 is in its downwardly pivoted loading and unloading position of FIG. 3 which is illustrated in dotted lines in FIG. 7.

Although the invention has been described in detail with reference to a certain preferred embodiment, variations and modifications exist within the scope and spirit of the present invention as described and defined in the following claims.

What is claimed is:

1. A storage rack apparatus configured to be mounted on a wall for holding articles, the apparatus comprising:

a back frame section configured to be rigidly coupled to the wall;

a bottom frame section pivotably coupled to the back frame section, the bottom frame section including a first support member and a second support member spaced apart from the first support member for holding the articles therebetween when the bottom section is in an upwardly pivoted storage position;

a loading bar coupled to the bottom frame section, the loading a frame member extending generally parallel to the first and second support members of the bottom section for holding the articles in a downwardly pivoted loading and unloading position;and at least one spring assist assembly coupled between the back frame section and the bottom frame section to assist pivotable movement of the bottom frame section and the loading bar relative to the back frame section, each spring assist assembly including a first support plate pivotably coupled to the back frame section, a second support plate pivotably coupled to the bottom frame section, and at least one spring coupled between the first and second support plates.

2. The apparatus of claim 1, wherein the bottom frame section includes a first side frame member and a second side frame member, the first and second side frame members being pivotably coupled to the back frame section, and wherein the first and second support members extend between the first and second side frame members.

3. The apparatus of claim 2, wherein the position of the second support member is adjustable on the first and second side frame members relative to the first support member of the bottom frame section.

4. The apparatus of claim 1, wherein a distance from the frame member of the loading bar to the first support member of the bottom frame section is adjustable.

5. The apparatus of claim 1, wherein the back frame section includes an extender section and the bottom frame section is pivotably coupled to the extender section about a pivot axis, the extender section being configured so that the at least one spring assist assembly moves past the pivot axis when the bottom frame section is in the downwardly pivoted loading and unloading position to hold the bottom frame section and loading bar in the downwardly pivoted loading and unloading position.

6. The apparatus of claim 1, further comprising a locking assembly coupled to the back frame section the locking assembly including a locking pin configured to engage an aperture formed in the bottom frame section to hold the bottom frame section in the upwardly pivoted storage position.

7. The apparatus of claim 1, further comprising a storage compartment coupled to the loading bar.

8. The apparatus of claim 1, further comprising a support frame apparatus including a fixed frame member rigidly coupled to the wall below the back frame section, the fixed frame member including first and second side walls, a pivot pin extending between the first and second side walls, and a front wall having a top surface located below the pivot pin, the support frame apparatus also including a pivotable frame member having first and second side walls and a bottom surface extending between the first and second side walls, the first and second side walls of the pivotable frame member each being formed to include an elongated slot for receiving the pivot pin therethrough, the elongated slots being configured so that the pivotable frame member is movable from an upwardly pivoted storage position in which the pivotable frame member slides into the fixed frame member to an outwardly pivoted position generally perpendicular to the fixed frame member in which the bottom surface of the pivotable frame member abuts the top surface of the front wall of the fixed frame member.

9. A support frame apparatus configured to be mounted on a wall, the apparatus comprising:

a fixed frame member rigidly coupled to the wall, the fixed frame member including first and second side walls, a pivot pin extending between the first and second side walls, and a front wall having a top surface located below the pivot pin; and a pivotable frame member having first and second side walls and a bottom surface extending between the first and second side walls, the first and second side walls of the pivotable frame member each being formed to include an elongated slot for receiving the pivot pin therethrough, the elongated slots being configured so that the pivotable frame member is movable from an upwardly pivoted storage position in which the pivotable frame member slides into the fixed frame member to an outwardly pivoted position generally perpendicular to the fixed frame member in which the bottom surface of the pivotable frame member abuts the top surface of the front wall of the fixed frame member.

10. A storage rack apparatus configured to be coupled to a wall for storing a plurality of tires, the apparatus comprising:

a back frame section configured to be rigidly coupled to the wall;

a bottom frame section pivotably coupled to the back frame section, the bottom frame section being pivotable relative to the back frame section from an upwardly pivoted storage position to a downwardly pivoted loading and unloading position, the bottom frame section including a first support member and a second support member spaced apart from the first support member for holding the tires in a nested position therebetween when the bottom section is in the upwardly pivoted storage position; and a loading bar coupled to the bottom frame section, the loading bar including a frame member extending generally parallel to the first support member of the bottom section for holding the tires in a nested position therebetween when the bottom frame section is in the downwardly pivoted loading and unloading position a distance from the frame member of the loading bar to the first support member of the bottom frame section being adjustable.

11. A storage rack apparatus configured to be coupled to a wall for storing a plurality of tires, the apparatus comprising:

a back frame section configured to be rigidly coupled to the wall;

a bottom frame section including first and second side frame members pivotably coupled to the back frame section, the bottom frame section being pivotable relative to the back frame section from an upwardly pivoted storage position to a downwardly pivoted loading and unloading position, the bottom frame section including first and second support extending between the first and second side frame members to hold the tires in a nested position therebetween when the bottom section is in the upwardly pivoted storage position, the position of the second support member being adjustable on the first and second side frame members relative to the first support member of the bottom frame section; and a loading bar coupled to the bottom frame section, the loading bar being configured to hold the tires on the storage rack when the bottom section is in the downwardly pivoted loading add unloading position.

12. A storage rack apparatus configured to be coupled to a wall for storing a plurality of tires, the apparatus comprising:

a back frame section configured to be rigidly coupled to the wall;

a bottom frame section pivotably couple to the back frame section, the bottom frame section being pivoted relative to the back frame section from an upwardly pivoted storage position to a downwardly pivoted loading and unloading position, the bottom frame section being configured to hold the tires on the storage rack when the bottom section is in the upwardly pivoted storage position;

a loading bar coupled to the bottom frame section, the loading bar being configured to bold the tires on the storage a rack when the bottom section is in the downwardly pivoted loading and unloading position; and a locking assembly coupled to the back frame section, the locking assembly including a locking pin configured to engage an aperture formed in the bottom frame section to hold the bottom frame section in the upwardly pivoted, storage position.

13. A storage rack apparatus configured to be mounted on a wall for holding at least one article, the apparatus comprising:

a back frame means configured to be rigidly coupled to the wall;

a bottom frame means pivotably coupled to the back frame means, the bottom frame means including a first support member and a second support member spaced apart from the first support member for holding the at least one article therebetween when the bottom frame means is in an upwardly pivoted storage position;

a loading bar means coupled to the bottom frame means, the loading bar means including a frame member extending generally parallel to the first and second support members of the bottom frame means for holding the at least one article in a downwardly pivoted loading and unloading position;

a storage compartment coupled to the loading bar means;

at least one spring assist assembly means coupled between the back frame means and the bottom frame means for biasing pivotable movement of the bottom frame means and the loading bar means toward the back frame means for holding the at least one article between the back frame means, the bottom frame means and the loading bar means in an article holding position; and wherein both said loading bar means and said bottom frame means contact, lift and force said at least one article against the back frame means in said article holding position in response to the biased pivotal movement caused by the spring assist assembly.

14. The apparatus of claim 11, wherein the loading bar includes a frame member extending generally parallel to the first support member of the bottom section for holding the tires in a nested position therebetween when the bottom frame section is in the downwardly pivoted loading and unloading position.

15. The apparatus of claim 10, wherein the bottom frame section includes a first side frame member and a second side frame member, the first and second side frame members being pivotably coupled to the back frame section, and wherein the first and second support members extend between the first and second side frame members.

16. The apparatus of claim 11, further comprising at least one spring assist assembly coupled between the back frame section and the bottom frame section to assist pivotable movement of the bottom frame section and the loading bar relative to the back frame section.

17. The apparatus of claim 16, wherein the spring assist assembly includes a first support plate pivotably coupled to the back frame section, a second support plate pivotably coupled to the bottom frame section, and at least one spring coupled between the first and second support plates.

18. The apparatus of claim 16, wherein the back frame section includes an extender section and the bottom frame section is pivotably coupled to the extender section about a pivot axis so that the at least one spring assist assembly moves past the pivot axis when the bottom frame section and the loading bar are in the downwardly pivoted loading and unloading position to hold the bottom frame section and loading bar in the downwardly pivoted loading and unloading position.

* * * * *